US010202754B2

(12) United States Patent
Hohmann, Jr.

(10) Patent No.: US 10,202,754 B2
(45) Date of Patent: Feb. 12, 2019

(54) THERMAL WALL ANCHOR

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 2 days.

(21) Appl. No.: 15/680,992

(22) Filed: Aug. 18, 2017

(65) Prior Publication Data

US 2017/0342707 A1 Nov. 30, 2017

Related U.S. Application Data

(63) Continuation of application No. 14/959,931, filed on Dec. 4, 2015.

(51) Int. Cl.
*E04B 1/41* (2006.01)
*E04B 1/76* (2006.01)

(52) U.S. Cl.
CPC ..... *E04B 1/4178* (2013.01); *E04B 1/76* (2013.01)

(58) Field of Classification Search
CPC ..... E04B 1/4178; E04B 1/76
USPC ..... 52/379, 378, 380, 381, 383, 426, 652, 52/656, 167.1, 698, 699, 562, 565
See application file for complete search history.

(56) References Cited

U.S. PATENT DOCUMENTS

D26,027 S 9/1896 von
819,869 A 5/1906 Dunlap
903,000 A 11/1908 Priest
1,014,157 A 1/1912 Lewen
1,170,419 A 2/1916 Coon et al.
1,359,978 A 11/1920 Folin
1,392,703 A 10/1921 Phillips
RE15,979 E 1/1925 Schaefer et al.
(Continued)

FOREIGN PATENT DOCUMENTS

CA 2502978 1/2009
CH 279209 3/1952
(Continued)

OTHER PUBLICATIONS

ASTM WK 2748, Leakage Air Barrier Assemblies, Jan. 2005.
(Continued)

*Primary Examiner* — Joshua K Ihezie
(74) *Attorney, Agent, or Firm* — Stinson Leonard Street LLP

(57) ABSTRACT

A wall anchor for use in a cavity wall to connect to a veneer tie to join an inner wythe and an outer wythe of the cavity wall includes an elongate body having a longitudinal axis, a driven end portion and a driving end portion. The driven end portion is adapted to be threadedly mounted on the inner wythe of the cavity wall. The driving end portion includes a drive head including a receptor opening for capturing a portion of a veneer tie. The receptor opening extends transverse to the longitudinal axis of the elongate body through the drive head. A thermal spacer is attached to the elongate bod. The thermal spacer has a conductivity less than a thermal conductivity of the elongate body and is configured and arranged to reduce thermal transfer in the cavity wall along the elongate body.

15 Claims, 7 Drawing Sheets

(56) References Cited

U.S. PATENT DOCUMENTS 1,541,518 A 6/1925 McCain
1,621,877 A 3/1927 Fitz Gerald
1,714,411 A 5/1929 Walter
1,794,684 A 3/1931 Handel
1,854,633 A 4/1932 Stephens
1,936,223 A 11/1933 Awbrey
1,942,863 A 1/1934 Johnstone
1,988,124 A 1/1935 Johnson
2,058,148 A 10/1936 Hard
2,097,821 A 11/1937 Mathers
2,121,213 A 6/1938 Small
2,130,531 A 9/1938 Arand
2,240,117 A 4/1941 Homolya
2,280,647 A 4/1942 Hawes
2,300,181 A 10/1942 Spaight
2,343,764 A 3/1944 Fuller
2,363,156 A 11/1944 Sinner et al.
2,403,566 A 7/1946 Thorp et al.
2,413,772 A 1/1947 Morehouse
2,605,867 A 8/1952 Goodwin
2,625,357 A 1/1953 Atkinson
2,780,936 A 2/1957 Hillberg
2,798,404 A 7/1957 Schaefer et al.
2,898,758 A 8/1959 Henrickson
2,909,054 A 10/1959 Phillips
2,929,238 A 3/1960 Kaye
2,948,045 A 8/1960 Imonetti
2,966,705 A 1/1961 Massey
2,999,571 A 9/1961 Huber
3,030,670 A 4/1962 Bigelow
3,088,361 A 5/1963 Hallock
3,114,220 A 12/1963 Maddox et al.
3,121,978 A 2/1964 Reiland
3,183,628 A 5/1965 Smith
3,254,736 A 6/1966 Gass
3,277,626 A 10/1966 Brynjolfsson et al.
3,292,336 A 12/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,342,005 A 9/1967 Rickards et al.
3,353,312 A 11/1967 Storch
3,377,764 A 4/1968 Storch
3,380,208 A 4/1968 Cook
3,440,922 A 4/1969 Cohen
3,478,409 A 11/1969 Votaw et al.
3,478,480 A 11/1969 Swenson
3,494,090 A 2/1970 Allen
3,500,713 A 3/1970 Bell
3,523,395 A 4/1970 Rutter et al.
D218,017 S 7/1970 Brown
3,529,508 A 9/1970 Cooksey
3,563,131 A 2/1971 Ridley, Sr.
3,568,389 A 3/1971 Gulow
3,587,198 A 6/1971 Hensel
3,621,626 A 11/1971 Tylius
3,640,043 A 2/1972 Querfeld et al.
3,707,815 A 1/1973 Molyneux
3,786,605 A 1/1974 Winfrey
3,803,972 A 4/1974 Deutsher
3,897,712 A 8/1975 Black
3,911,783 A 10/1975 Gapp et al.
3,925,996 A 12/1975 Wiggill
3,964,226 A 6/1976 Hala et al.
3,964,227 A 6/1976 Hala
4,002,001 A 1/1977 Uydess
4,021,990 A 5/1977 Schwalberg
4,060,951 A 12/1977 Gere
4,107,890 A 8/1978 Seghezzi et al.
4,108,560 A 8/1978 Minogue
4,130,977 A 12/1978 Taylor, Jr. et al.
4,227,359 A 10/1980 Schlenker
4,238,987 A 12/1980 Siebrecht-Reuter
D259,171 S 5/1981 Wallace
4,281,494 A 8/1981 Weinar
4,305,239 A 12/1981 Geraghty
4,329,823 A 5/1982 Simpson
4,350,464 A 9/1982 Brothers
4,367,892 A 1/1983 Holt
4,373,314 A 2/1983 Allan
4,382,416 A 5/1983 Kellogg-Smith
4,410,760 A 10/1983 Cole
4,422,617 A 12/1983 Gallis
4,424,745 A 1/1984 Magorian et al.
4,426,061 A 1/1984 Taggart
4,430,035 A 2/1984 Rodseth
4,438,611 A 3/1984 Bryant
4,460,300 A 7/1984 Bettini et al.
4,473,209 A 9/1984 Gallis et al.
4,473,984 A 10/1984 Lopez
4,482,368 A 11/1984 Roberts
4,484,422 A 11/1984 Roberts
4,523,413 A 6/1985 Koppenberg
4,571,909 A 2/1986 Berghuis et al.
4,596,102 A 6/1986 Catani et al.
4,598,518 A 7/1986 Hohmann
4,600,344 A 7/1986 Sutenbach et al.
4,604,003 A 8/1986 Francoeur et al.
4,606,163 A 8/1986 Catani
4,622,796 A 11/1986 Aziz et al.
4,628,657 A 12/1986 Ermer et al.
4,631,889 A 12/1986 Adam et al.
4,636,125 A 1/1987 Burgard
4,640,848 A 2/1987 Cerdan-Diaz et al.
4,653,244 A 3/1987 Farrell
4,656,806 A 4/1987 Leibhard et al.
4,660,342 A 4/1987 Salisbury
4,680,913 A 7/1987 Geisen et al.
4,688,363 A 8/1987 Sweeney et al.
4,703,604 A 11/1987 Muller
4,708,551 A 11/1987 Richter et al.
4,714,507 A 12/1987 Ohgushi
4,723,866 A 2/1988 McCauley
4,736,554 A 4/1988 Tyler
4,738,070 A 4/1988 Abbott et al.
4,742,659 A 5/1988 Meilleur
4,757,662 A 7/1988 Gasser
4,764,069 A * 8/1988 Reinwall ..... B25B 13/5091
411/397
4,819,401 A 4/1989 Whitney, Jr.
4,825,614 A 5/1989 Bennett et al.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,887,951 A 12/1989 Hashimoto
4,911,949 A 3/1990 Iwase et al.
4,922,680 A 5/1990 Kramer et al.
4,923,348 A 5/1990 Carlozzo et al.
4,946,632 A 8/1990 Pollina
4,948,319 A 8/1990 Day et al.
4,955,172 A 9/1990 Pierson
4,970,842 A 11/1990 Kappeler et al.
4,993,902 A 2/1991 Hellon
5,012,624 A 5/1991 Dahlgren
5,016,855 A 5/1991 Huggins
5,063,722 A 11/1991 Hohmann
5,099,628 A 3/1992 Noland et al.
5,207,043 A 5/1993 McGee et al.
5,209,619 A 5/1993 Rinderer
5,243,805 A 9/1993 Fricker
5,307,602 A 5/1994 Lebraut
5,338,141 A 8/1994 Hulsey
5,347,781 A 9/1994 Hanlon
5,392,581 A 2/1995 Hatzinikolas et al.
5,395,196 A 3/1995 Notaro
5,408,798 A 4/1995 Hohmann
5,433,569 A 7/1995 Fall et al.
5,439,338 A 8/1995 Rosenberg
5,440,854 A 8/1995 Hohmann
5,454,200 A 10/1995 Hohmann

(56) References Cited

U.S. PATENT DOCUMENTS 5,456,052 A 10/1995 Anderson et al.
5,490,366 A 2/1996 Burns et al.
5,501,306 A 3/1996 Martino
5,518,351 A 5/1996 Peil
D373,623 S 9/1996 Mathison
5,562,377 A 10/1996 Giannuzzi et al.
5,598,673 A 2/1997 Atkins
5,634,310 A 6/1997 Hohmann
5,638,584 A 6/1997 De Anfrasio
5,644,889 A 7/1997 Getz
5,669,592 A 9/1997 Kearful
5,671,578 A 9/1997 Hohmann
5,673,527 A 10/1997 Coston et al.
RE35,659 E 11/1997 Ernst et al.
5,755,070 A 5/1998 Hohmann
D397,401 S 8/1998 Diederich
5,806,275 A 9/1998 Giannuzzi et al.
5,816,008 A 10/1998 Hohmann
5,819,486 A 10/1998 Goodings
5,836,126 A 11/1998 Harkenrider et al.
5,845,455 A 12/1998 Johnson, III
D406,524 S 3/1999 Steenson et al.
5,953,865 A 9/1999 Rickards
D417,139 S 11/1999 Pitre
6,000,178 A 12/1999 Goodings
6,009,677 A 1/2000 Anderson
6,033,153 A 3/2000 Fergusson
6,098,364 A 8/2000 Liu
6,125,608 A 10/2000 Charlson
6,128,883 A 10/2000 Hatzinikolas
6,131,360 A 10/2000 Dalen
6,138,941 A 10/2000 Miyake
6,176,662 B1 1/2001 Champney et al.
6,209,281 B1 4/2001 Rice
6,279,283 B1 8/2001 Hohmann et al.
6,284,311 B1 9/2001 Gregorovich et al.
6,293,744 B1 9/2001 Hempling et al.
6,311,785 B1 * 11/2001 Paterson ..... B23B 51/02 173/1
6,332,300 B1 12/2001 Wakai
6,345,472 B1 2/2002 Taylor
6,351,922 B1 3/2002 Burns et al.
6,367,219 B1 4/2002 Quinlan
6,401,406 B1 6/2002 Komara
6,502,362 B1 1/2003 Zambelli et al.
6,508,447 B1 1/2003 Cantani et al.
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,709,213 B2 3/2004 Bailey
6,718,774 B2 4/2004 Razzell
6,735,915 B1 5/2004 Johnson, III
6,739,105 B2 5/2004 Fleming
6,763,640 B2 7/2004 Lane
6,789,365 B1 9/2004 Hohmann et al.
6,802,675 B2 10/2004 Timmons et al.
6,812,276 B2 11/2004 Yeager
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,918,218 B2 7/2005 Greenway
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
D530,796 S 10/2006 Zielke et al.
7,114,900 B2 10/2006 Toosky
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,404,274 B2 7/2008 Hayes
7,415,803 B2 8/2008 Bronner
7,421,826 B2 9/2008 Collins et al.
7,469,511 B2 12/2008 Wobber
7,481,032 B2 1/2009 Tarr
7,552,566 B2 6/2009 Hyde et al.
7,562,506 B2 7/2009 Hohmann, Jr.
7,568,320 B2 * 8/2009 Paterson ..... E04B 1/4178 52/282.4
7,587,874 B2 9/2009 Hohmann, Jr.
7,596,917 B2 10/2009 Schloemer et al.
D603,251 S 11/2009 King
D605,500 S 12/2009 Lee et al.
7,654,057 B2 2/2010 Zambelli et al.
7,698,861 B2 4/2010 Bogue
7,717,015 B2 5/2010 Nilsen et al.
7,735,292 B2 6/2010 Massie
7,744,321 B2 6/2010 Wells
7,748,181 B1 7/2010 Guinn
7,779,581 B2 8/2010 Flaherty et al.
7,788,869 B2 9/2010 Voegele, Jr.
D625,977 S 10/2010 Watson et al.
D626,817 S 11/2010 Donowho et al.
7,845,137 B2 12/2010 Hohmann, Jr.
7,918,634 B2 4/2011 Conrad et al.
8,015,757 B1 9/2011 Hohmann, Jr.
8,029,223 B2 10/2011 Mair
8,037,653 B2 10/2011 Hohmann, Jr.
8,046,956 B1 11/2011 Hohmann, Jr.
8,051,619 B2 11/2011 Hohmann, Jr.
8,092,134 B2 1/2012 Oguri et al.
8,096,090 B1 1/2012 Hohmann, Jr. et al.
8,109,706 B2 2/2012 Richards
8,122,663 B1 2/2012 Hohmann, Jr. et al.
D658,046 S 4/2012 Austin, III
8,154,859 B2 4/2012 Shahrokhi
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
D672,639 S 12/2012 Pawluk
8,347,581 B2 1/2013 Doerr et al.
8,375,667 B2 2/2013 Hohmann, Jr.
8,418,422 B2 4/2013 Johnson, III
8,468,765 B1 6/2013 Kim
8,490,363 B2 7/2013 Nagy et al.
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,561,366 B2 10/2013 Gasperi
8,596,010 B2 12/2013 Hohmann, Jr.
8,609,224 B2 12/2013 Li et al.
8,613,175 B2 12/2013 Hohmann, Jr.
8,635,832 B2 1/2014 Heudorfer et al.
8,661,741 B2 3/2014 Hohmann, Jr.
8,661,766 B2 3/2014 Hohmann, Jr.
8,667,757 B1 3/2014 Hohmann, Jr.
8,726,596 B2 5/2014 Hohmann, Jr.
8,726,597 B2 5/2014 Hohmann, Jr.
8,733,049 B2 5/2014 Hohmann, Jr.
8,739,485 B2 6/2014 Hohmann, Jr.
8,800,241 B2 8/2014 Hohmann, Jr.
8,807,877 B1 8/2014 Fox
8,833,003 B1 8/2014 Hohmann, Jr.
8,839,581 B2 9/2014 Hohmann, Jr.
8,839,587 B2 9/2014 Hohmann, Jr.
8,844,229 B1 9/2014 Hohmann, Jr.
8,863,460 B2 10/2014 Hohmann, Jr.

(56) References Cited

U.S. PATENT DOCUMENTS 8,881,488 B2 11/2014 Hohmann, Jr. et al.
8,898,980 B2 12/2014 Hohmann, Jr.
8,904,726 B1 12/2014 Hohmann, Jr.
8,904,727 B1 12/2014 Hohmann, Jr.
8,904,730 B2 12/2014 Hohmann, Jr.
8,904,731 B2 12/2014 Hohmann, Jr.
8,910,445 B2 * 12/2014 Hohmann, Jr. ..... E04B 1/4178 52/565
8,920,092 B2 12/2014 D'Addario et al.
8,978,326 B2 3/2015 Hohmann, Jr.
8,978,330 B2 3/2015 Hohmann, Jr.
8,984,837 B2 3/2015 Curtis et al.
9,038,351 B2 5/2015 Hohmann, Jr.
9,273,460 B2 3/2016 Hohmann, Jr.
9,273,461 B1 3/2016 Hohmann, Jr.
9,273,714 B2 3/2016 Jackson
9,482,003 B2 11/2016 Browning et al.
9,523,197 B2 * 12/2016 Sessler ..... E04B 2/7457
9,702,154 B2 7/2017 Wessendorf
2001/0054270 A1 12/2001 Rice
2002/0047488 A1 4/2002 Webb et al.
2002/0100239 A1 8/2002 Lopez
2003/0121226 A1 7/2003 Bolduc
2003/0208968 A1 11/2003 Lancelot, III et al.
2003/0217521 A1 11/2003 Richardson et al.
2004/0003558 A1 1/2004 Collins et al.
2004/0083667 A1 5/2004 Johnson, III
2004/0187421 A1 9/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0046187 A1 3/2005 Takeuchi et al.
2005/0129485 A1 6/2005 Swim, Jr.
2005/0183382 A1 * 8/2005 Jensen ..... B29C 65/5042 52/741.3
2005/0279042 A1 12/2005 Bronner
2005/0279043 A1 12/2005 Bronner
2006/0005490 A1 1/2006 Hohmann, Jr.
2006/0198717 A1 9/2006 Fuest
2006/0242921 A1 11/2006 Massie
2006/0251916 A1 11/2006 Arikawa et al.
2007/0011964 A1 1/2007 Smith
2007/0059121 A1 3/2007 Chien
2008/0092472 A1 4/2008 Doerr et al.
2008/0141605 A1 6/2008 Hohmann
2008/0166203 A1 7/2008 Reynolds et al.
2008/0222992 A1 9/2008 Hikai et al.
2009/0133351 A1 5/2009 Wobber
2009/0133357 A1 * 5/2009 Richards ..... E04B 1/4178 52/698
2009/0173828 A1 7/2009 Oguri et al.
2010/0037552 A1 2/2010 Bronner
2010/0071307 A1 3/2010 Hohmann, Jr.
2010/0101175 A1 4/2010 Hohmann
2010/0192495 A1 8/2010 Huff et al.
2010/0257803 A1 10/2010 Hohmann, Jr.
2011/0023748 A1 2/2011 Wagh et al.
2011/0041442 A1 2/2011 Bui
2011/0047919 A1 * 3/2011 Hohmann, Jr. ..... E04B 1/4178 52/513
2011/0061333 A1 3/2011 Bronner
2011/0083389 A1 4/2011 Bui
2011/0146195 A1 6/2011 Hohmann, Jr.
2011/0164943 A1 7/2011 Conrad et al.
2011/0173902 A1 7/2011 Hohmann, Jr. et al.
2011/0189480 A1 8/2011 Hung
2011/0277397 A1 11/2011 Hohmann, Jr.
2012/0011793 A1 * 1/2012 Clark ..... E04C 3/122 52/309.4
2012/0037582 A1 * 2/2012 Wang ..... E04B 9/001 52/513
2012/0186183 A1 7/2012 Johnson, III
2012/0285111 A1 11/2012 Johnson, III
2012/0304576 A1 * 12/2012 Hohmann, Jr. ..... E04B 1/4178 52/513
2012/0308330 A1 * 12/2012 Hohmann, Jr. ..... E04B 1/4178 411/387.1
2013/0008121 A1 1/2013 Dalen
2013/0074435 A1 3/2013 Hohmann, Jr.
2013/0074442 A1 3/2013 Hohmann, Jr.
2013/0232893 A1 9/2013 Hohmann, Jr.
2013/0232909 A1 * 9/2013 Curtis ..... E04B 1/4178 52/704
2013/0247482 A1 9/2013 Hohmann, Jr.
2013/0247483 A1 * 9/2013 Hohmann, Jr. ..... E04B 1/4178 52/167.1
2013/0247484 A1 9/2013 Hohmann, Jr.
2013/0247498 A1 * 9/2013 Hohmann, Jr. ..... E04B 1/4178 52/582.1
2013/0280013 A1 * 10/2013 Gong ..... E04D 3/3606 411/387.1
2013/0340378 A1 * 12/2013 Hohmann, Jr. ..... E04B 1/4178 52/705
2014/0000211 A1 1/2014 Hohmann, Jr.
2014/0075855 A1 * 3/2014 Hohmann, Jr. ..... E04F 13/0805 52/167.1
2014/0075856 A1 3/2014 Hohmann, Jr.
2014/0075879 A1 3/2014 Hohmann, Jr.
2014/0096466 A1 4/2014 Hohmann, Jr.
2014/0174013 A1 6/2014 Hohmann, Jr. et al.
2014/0202098 A1 7/2014 De Smet et al.
2014/0215958 A1 8/2014 Duyvejonck et al.
2014/0250826 A1 8/2014 Hohmann, Jr.
2014/0260065 A1 9/2014 Hohmann, Jr.
2014/0318074 A1 10/2014 Heudorfer et al.
2014/0345208 A1 11/2014 Hohmann, Jr.
2015/0033651 A1 2/2015 Hohmann, Jr.
2015/0096243 A1 4/2015 Hohmann, Jr.
2015/0121792 A1 * 5/2015 Spoo ..... E04B 1/4178 52/483.1
2016/0160493 A1 6/2016 Hohmann, Jr.
2017/0045068 A1 * 2/2017 Sikorski ..... F16L 13/103

FOREIGN PATENT DOCUMENTS

DE 231696 6/1909
DE 1960453 6/1970
DE 2856205 A1 7/1980
EP 0 199 595 B1 3/1995
GB 1 575 501 9/1980
GB 2 069 024 A 8/1981
GB 2 246 149 A 1/1992
GB 2 265 164 A 9/1993
GB 2459936 B 3/2013
WO 0166962 A1 9/2001
WO 2011123873 A2 10/2011

OTHER PUBLICATIONS

Wire Bond Corp, "Wire-Bond Sure Tie" and "Wire-Bond Clip". Product Catalog Sheet, Charlotte, NC, known as of Sep. 3, 2008.
Heckmann Building Products, Inc. Pos-I-Tie Air Infiltration and Water Penetration Test, Aug. 2003. htt;://www.heckmannbuildingprods.com/PPosTest.htm.
Heckmann Building Products, Inc. "Wing Nut Pos-I-Tie" Product Catalogue Sheet, Melrose Park, IL, known as of Sep. 3, 2008.
www.heckmanbuildingprods.com, Heckman General Catalog for 2006, Oct. 28, 2006 pp. 4-5.
ASTM Standard E754-80 (2006), Standard Test Method for Pullout Resistance of Ties and Anchors Embedded in Masonry Mortar Joints, ASTM International, 8 pages, West Conshohocken, Pennsylvania, United States.
ASTM Standard Specification A951/A951M-11, Table 1, Standard Specification for Steel Wire for Masonry Joint Reinforcement, Nov. 14, 2011, 6 pages, West Conshohocken, Pennsylvania, United States.
State Board of Building Regulations and Standards, Building Envelope Requirements, 780 CMR sec. 1304.0 et seq., 7th Edition, Aug. 22, 2008, 11 pages, Boston, MA, United States.

(56) References Cited

OTHER PUBLICATIONS

Building Code Requirements for Masonry Structures and Commentary, TMS 402-11/ACI 530-11/ASCE 5-11, 2011, Chapter 6, 12 pages.
Hohmann & Barnard, Inc., Product Catalog, 44 pgs (2003).
Hohmann & Barnard, Inc.; Product Catalog, 2009, 52 pages, Hauppauge, New York, United States.
Hohmann & Barnard, Inc., Product Catalog, 2013, 52 pages, Hauppauge, New York, United States.
Kossecka PH.D, et al, Effect of Insulation and Mass Distribution in Exterior Walls on Dynamic Thermal Performance of Whole Buildings, Thermal Envelopes VII/Building Systems—Principles p. 721-731, 1998, 11 pages.
Hohmann & Barnard, Inc., Design and Fabrication of Stone Support and Masonry Anchor Systems, Product catalog, p. A20, 2007(Cited in MLP 7678.CA Apr. 6, 2016 OA) Requested from FA May 3, 2016.
U.S. Final Office action, U.S. Appl. No. 14/959,931, dated Nov. 14, 2017, 8 pages.
Non-Final Rejection, dated Mar. 9, 2018, U.S. Appl. No. 14/959,931, filed Dec. 4, 2015, 10 pgs.

* cited by examiner

THERMAL WALL ANCHOR

CROSS-REFERENCE TO RELATED APPLICATION

This application is a continuation of U.S. application Ser. No. 14/959,931, filed Dec. 4, 2015, the entire contents of which are incorporated herein by reference.

FIELD OF THE INVENTION

The present invention generally relates to anchoring systems for insulated cavity walls, and more specifically, a thermal wall anchor that creates a thermal break in a cavity wall.

BACKGROUND

Anchoring systems for cavity walls are used to secure veneer facings to a building and overcome seismic and other forces (e.g., wind shear, etc.). Anchoring systems generally form a conductive bridge or thermal pathway between the cavity and the interior of the building through metal-to-metal contact. Optimizing the thermal characteristics of cavity wall construction is important to ensure minimized heat transfer through the walls, both for comfort and for energy efficiency of heating and air conditioning. When the exterior is cold relative to the interior of a heated structure, heat from the interior should be prevented from passing through to the outside. Similarly, when the exterior is hot relative to the interior of an air conditioned structure, heat from the exterior should be prevented from passing through to the interior.

SUMMARY

In one aspect, a wall anchor for use in a cavity wall to connect to a veneer tie to join an inner wythe and an outer wythe of the cavity wall includes an elongate body having a longitudinal axis, a driven end portion and a driving end portion. The driven end portion is adapted to be threadedly mounted on the inner wythe of the cavity wall. The driving end portion includes a drive head including a receptor opening for capturing a portion of a veneer tie. The receptor opening extends transverse to the longitudinal axis of the elongate body through the drive head. A thermal spacer is attached to the elongate body. The thermal spacer has a conductivity less than a thermal conductivity of the elongate body and is configured and arranged to reduce thermal transfer in the cavity wall along the elongate body.

In another aspect, a wall anchor for use in a cavity wall to connect to a veneer tie to join an inner wythe and an outer wythe of the cavity wall includes an elongate body having a longitudinal axis, a driven end portion, a driving end portion, and at least one barrel portion positioned between the driven end portion and the driving end portion. The driven end portion is adapted to be threadedly mounted on the inner wythe of the cavity wall and includes a threaded portion. The driving end portion includes a drive head having a receptor opening for capturing a portion of a veneer tie. The receptor opening extends transverse to the longitudinal axis of the elongate body through the drive head. The at least one barrel portion comprises a hollow body having a circumferential wall defining a hollow interior.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
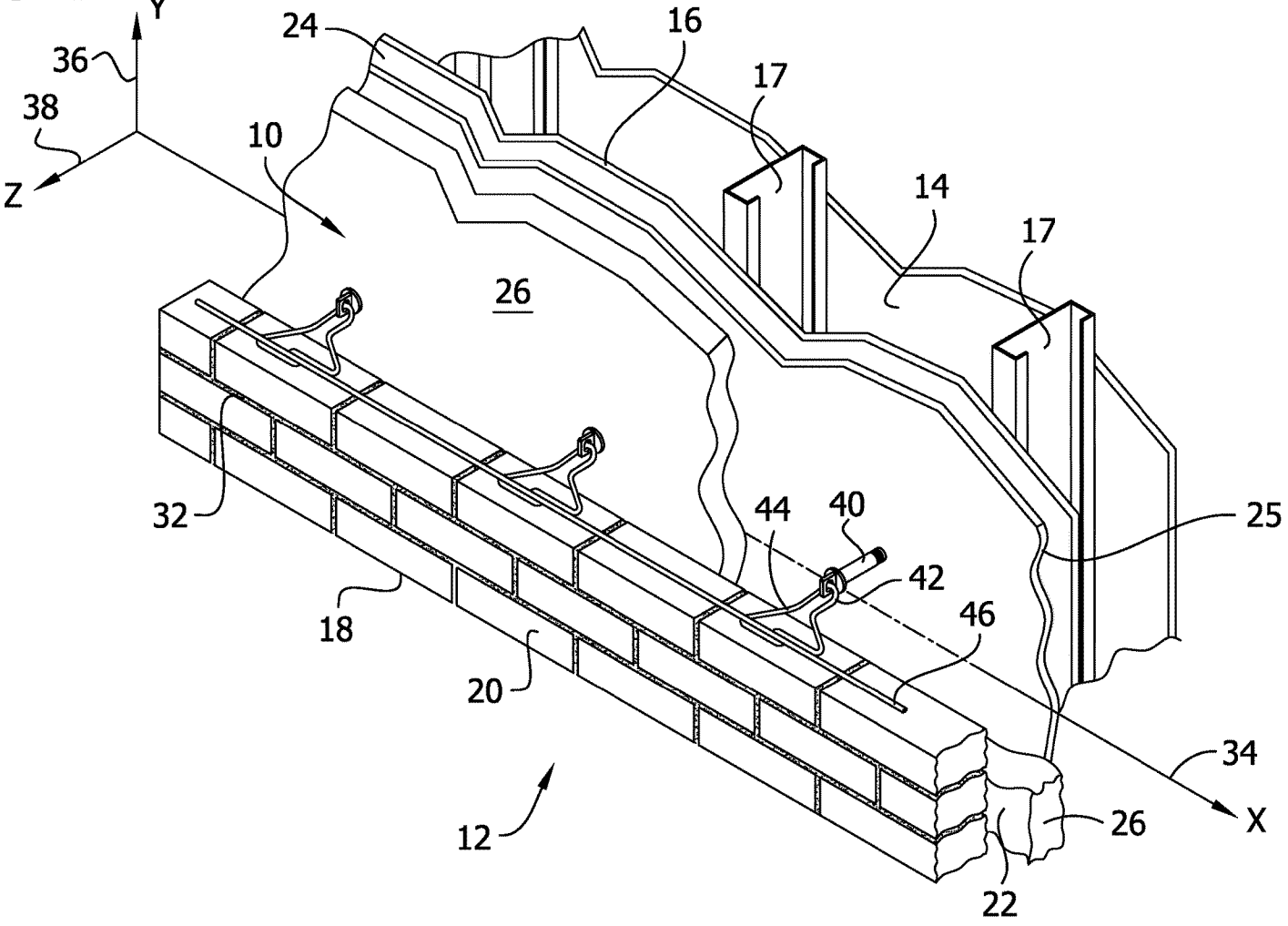
FIG. 1 is a perspective of an anchoring system as applied to a cavity wall with an inner wythe of an insulated dry wall construction and an outer wythe of brick.
Figure 2:
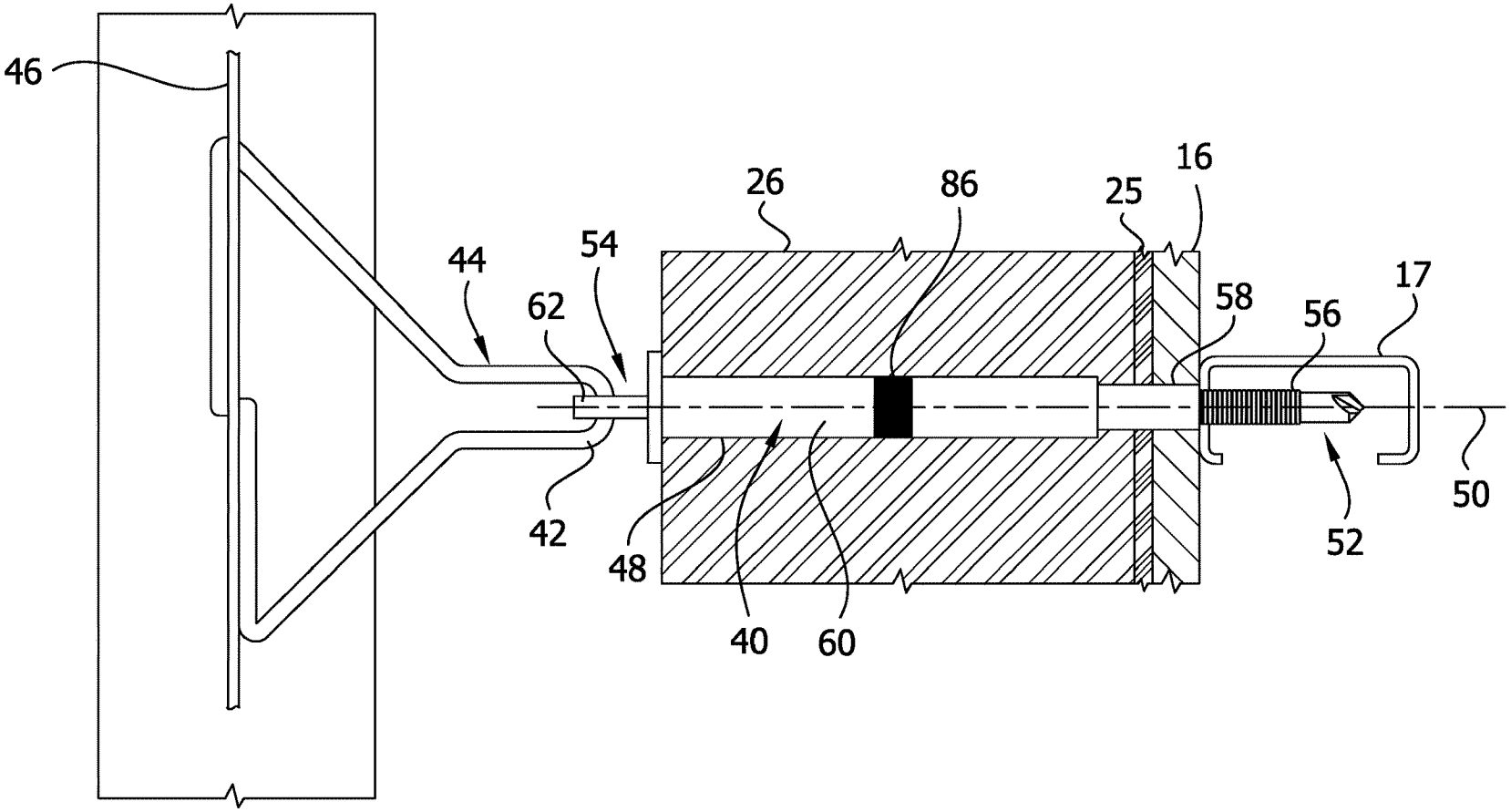
FIG. 2 is an enlarged fragmentary schematic elevation, partially in section, illustrating the anchoring system in use.

Referring to FIGS. 1 and 2, an anchoring system for cavity walls is shown generally at 10. A cavity wall structure generally indicated at 12 comprises an inner wythe or drywall backup 14 with sheetrock or wallboard 16 mounted on metal columns or studs 17 and an outer wythe or facing wall 18 of brick 20 construction. Between the inner wythe 14 and the outer wythe 18, a cavity 22 is formed. An air/vapor barrier 25 and insulation 26 are attached to an exterior surface of the inner wythe 14 and located in the cavity 22.

Successive bed joints 30 and 32 are substantially planar and horizontally disposed and, in accordance with building standards, are approximately 0.375 inches (9.525 mm) in height in a typical embodiment. Selective ones of bed joints 30 and 32, which are formed between courses of bricks 20, are constructed to receive the insertion portion of a veneer tie 44. It is understood that the described and illustrated wall structure 12 is exemplary only. Other structures may be used without departing from the scope of the present invention. A wall anchor 40 is threadedly mounted on the inner wythe 14 and is supported by the inner wythe. As described in greater detail below, the wall anchor 40 is configured to provide a thermal break in the cavity wall structure 12. The anchoring system 10 is constructed and configured to minimize air and moisture penetration around the wall anchor system/inner wythe juncture and limit thermal transfer.

For purposes of the description, an exterior cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes.

In the illustrated embodiment, the anchoring system 10 includes wall anchor 40, veneer tie 44, and an optional wire or outer wythe reinforcement 46. At intervals along the exterior surface 24 of the inner wythe 14, wall anchors 40 are driven into place in anchor-receiving channels 48 (see FIG. 2). Anchor-receiving channels 48 can be pre-drilled, or, alternatively, wall anchor 40 can be used to drill its own channel. The wall anchors 40 are positioned so that a longitudinal axis 50 of the wall anchor is normal to the xy-plane and taps into stud 17. Veneer tie 44 is shown in FIG. 1 as being placed on a course of bricks in preparation for being embedded in the mortar of bed joint 30. The veneer tie 44 is formed of wire and includes an attachment portion or U-shaped rear leg portion 42, as is known in the art. The wire reinforcement 46 is also constructed of a wire, as is known in the art, and preferably conforms to the joint reinforcement requirements of ASTM Standard Specification A951-00, Table 1. Wall anchors and veneer ties can be configured in other ways within the scope of the present invention.

In a first embodiment illustrated in FIGS. 1-4, the wall anchor 40 includes an elongate body that extends along a longitudinal axis 50 of the wall anchor from a driven end portion 52 to a driving end portion 54. The driven end portion 52 includes a threaded portion 56 (e.g., a self-drilling screw portion). The threaded portion 56 can be configured for attachment to a metal stud, a wooden stud, a concrete backup wall, or alternative backup wall constructions. In use, the driven end portion 52 is driven into an inner wythe (e.g., a stud of an inner wythe) of a cavity wall, mounting the wall anchor 40 on the inner wythe.

Figure 3:
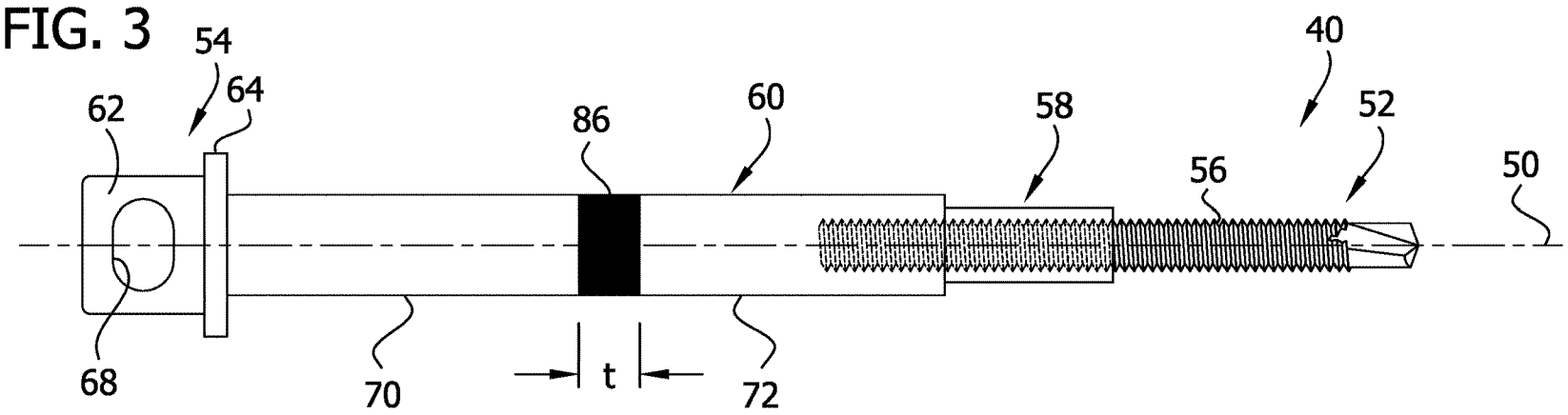
FIG. 3 is a front view of a thermal wall anchor according to an embodiment of the present invention, the rear view being a mirror image thereof.
Figure 4:
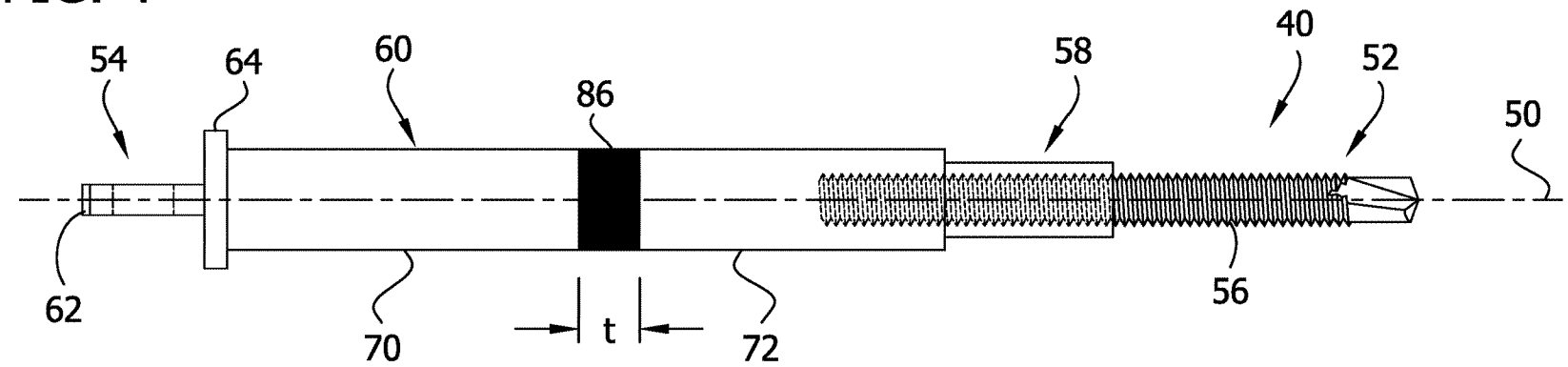
FIG. 4 is a top plan view thereof, the bottom plan view being identical thereto.

The elongate body of the wall anchor 40 includes a non-threaded barrel extending between the driven end portion 52 and the driving end portion 54. In the embodiment of FIGS. 3 and 4, the wall anchor 40 includes a dual-diameter barrel having a smaller diameter barrel or first shaft portion 58 toward the driven end portion 52 and a larger diameter barrel or second shaft portion 60 toward the driving end portion 54. A drive head 62 is located at the driving end portion 54 of the anchor 40. The elongate body includes a flange 64 at the junction of the drive head 62 and the larger diameter barrel portion 60. The drive head 62 defines a receptor or aperture 68 for receiving an attachment portion of a veneer tie, such as the U-shaped rear leg portion 42 of the veneer tie 44. As shown in FIGS. 1 and 2, the rear leg 42 of the veneer tie 44 is inserted into the aperture 68 of the drive head 62, thereby securing the veneer tie to the wall anchor 40.

The wall anchor 40 includes a thermal spacer 86 that is configured to provide a thermal break in the wall anchor. The main components of the wall anchor 40 are preferably made of metal (e.g., steel) to provide a high-strength anchoring system. Alternatively, the wall anchor can be made of plastic or other suitable material. In one embodiment, the main components of the wall anchor are made of stainless steel. Through the use of a thermal spacer 86, the thermal transmission values of the wall anchor are lowered. The thermal spacer 86 is preferably a non-conductive material. For example, the thermal spacer 86 can be ceramic, plastic, epoxy, carbon fiber, a non-conductive metal, or other non-conductive material.

As seen in FIGS. 3 and 4, the larger diameter barrel portion 60 includes first and second thermally-conductive portions 70, 72 separated by the non-conductive thermal spacer 86. The thermal spacer 86 is attached to both the first and second thermally-conductive portions 70, 72 (e.g., glued). The thermal spacer 86 is configured to provide a thermal break between the first and second thermally-conductive portions 70, 72. Thus, when the wall anchor 40 is attached to an inner wythe as part of the anchoring system 10, the thermal spacer interrupts the thermal pathway through the cavity wall. In other words, the transmission of heat between the outer wythe (via a veneer tie attached to the outer wythe and attached to the wall anchor 40) and the inner wythe (via the wall anchor attached to the inner wythe) of a cavity wall is reduced. The thermal spacer 86 preferably has a thickness selected to provide a thermal break between thermally-conductive portions 70, 72 attached to the thermal spacer. For example, in one embodiment, the thermal spacer 86 has a thickness t of about 0.250 inches (6.35 mm).

The thermal spacer 86 of the wall anchor 40 causes the cavity wall 12 to obtain a lower transmission value (U-value), thereby providing an anchoring system with the benefits of thermal isolation. The term U-value is used to describe the transmission of heat through the entire cavity wall (including the anchor, the insulation, and other components), i.e., the measure of the rate of transfer of heat through one square meter of a structure divided by the difference in temperature across the structure. The lower the U-value, the better the thermal integrity of the cavity wall, and the higher the U-value, the worse the thermal performance of the building envelope. The U-value is calculated from the reciprocal of the combined thermal resistances of the materials in the cavity wall, taking into account the effect of thermal bridges, air gaps and fixings. Several factors affect the U-value, such as the size of the cavity, the thickness of the insulation, the materials used, etc. In one exemplary test, a cavity wall structure was modeled to measure the U-value in an anchoring system 10 as described, with a thermal spacer 86 in the wall anchor 40. The wall included, from the exterior face to the interior face, an outer wythe comprising standard 3⅝ inch thick brick veneer, a 1.5 inch slightly ventilated air cavity, 4 inches of mineral wool exterior insulation, ⅝ inch exterior sheathing, a 3⅝ inch steel stud, and ½ inch gypsum board. In the model, veneer ties are embedded into the brick mortar and wall anchors penetrated through the insulation and into the steel stud. The effective assembly U-value was 0.053 BTU/(hr·ft$^2$·° F.) (0.302 W/m$^2$K), for a thermal efficiency of 89.0%. In another model, an anchoring system included a dual diameter barrel wall anchor without a thermal spacer, and the effective assembly U-value was 0.058 BTU/(hr·ft$^2$·° F.) (0.332 W/m$^2$K), for a thermal efficiency of 81.0%. Although only an illustrative model, the test results indicate that the U-value of the cavity wall structure is reduced through use of a wall anchor including a thermal spacer.

Figure 5:
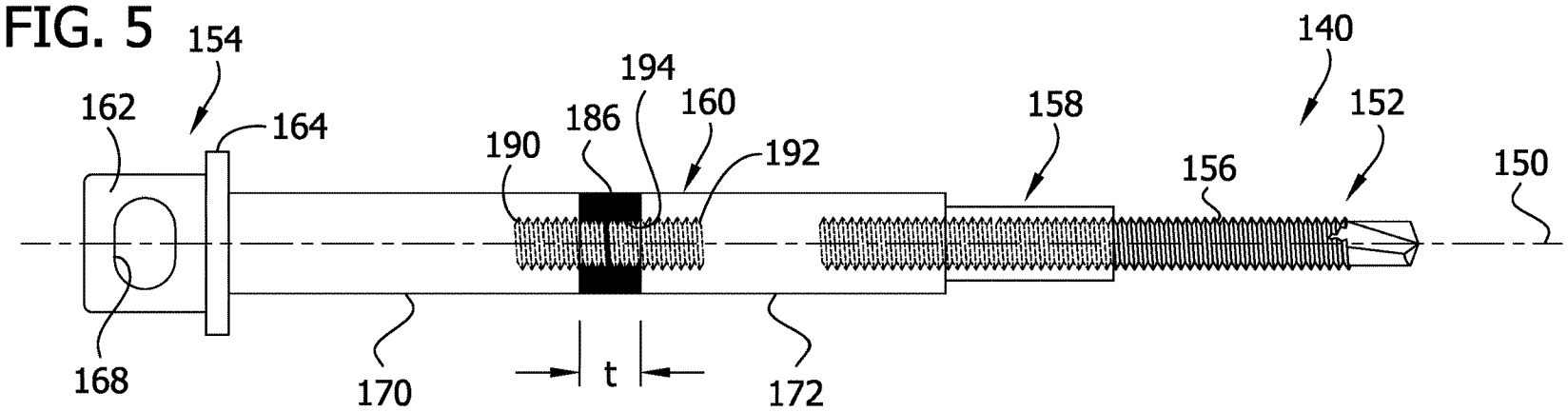
FIG. 5 is a front view of a thermal wall anchor according to a second embodiment, the rear view being a mirror image thereof.
Figure 6:
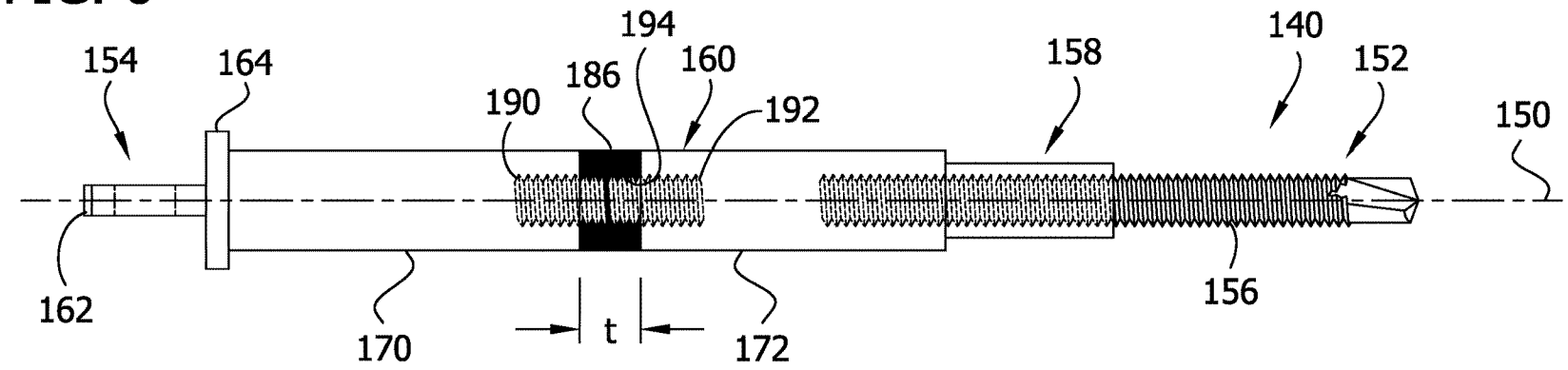
FIG. 6 is a top plan view thereof, the bottom plan view being identical thereto.

A second embodiment of a wall anchor with thermal spacer is illustrated in FIGS. 5 and 6. Wall anchor 140 is substantially similar to wall anchor 40 described above, with differences as pointed out herein. Parts of the wall anchor 140 corresponding to those of the anchor 40 are given the same reference numeral, plus "100."

Wall anchor 140 includes an elongate body that extends along the longitudinal axis 150 of the anchor from a driven end portion 152 to a driving end portion 154. The driven end portion 152 includes a threaded portion 156 configured for attachment to an inner wythe (e.g., a metal stud). Wall anchor 140 is used as described above with reference to wall anchor 40. Wall anchor 140 includes a dual-diameter barrel having a smaller diameter barrel or first shaft portion 158 and a larger diameter barrel or second shaft portion 160. A drive head 162 is located at the driving end portion 154 of the anchor 140. The elongate body includes a flange 164 at the junction of the drive head 162 and the barrel 160. The drive head 162 defines a receptor or aperture 168 for receiving a portion of a veneer tie, as described above.

The wall anchor 140 includes a thermal spacer 186 that is configured to provide a thermal break in the wall anchor. The main components of the wall anchor are preferably made of metal (e.g., steel) to provide a high-strength anchoring system. Alternatively, the wall anchor can be made of plastic or other suitable material. In one embodiment, the main components of the wall anchor are made of stainless steel. Through the use of a thermal spacer 186, the thermal transmission values of the wall anchor are lowered. The thermal spacer 186 is preferably a non-conductive material. For example, the thermal spacer 186 can be ceramic, plastic, epoxy, carbon fiber, a non-conductive metal, or other non-conductive material.

As seen in FIGS. 5 and 6, the larger diameter barrel portion 160 includes first and second thermally-conductive portions 170, 172 separated by the non-conductive thermal spacer 186. The thermal spacer 186 is attached to both the first and second thermally-conductive portions 170, 172. As illustrated, the thermal spacer 186 is attached to each of the first and second thermally-conductive portions by threaded engagement. The first thermally-conductive portion 170 includes a threaded stud 190. The second thermally-conductive portion 172 includes a threaded stud 192. The threaded studs 190, 192 can be made of stainless steel, plastic, fiberglass, epoxy or any other suitable material. The thermal spacer 186 includes a threaded opening 194 configured to receive the studs 190, 192. As illustrated in FIGS. 5 and 6, when both of the threaded studs 190, 192 are received in the threaded opening 194, the studs are spaced from each other and do not make contact. Thus, when the wall anchor 140 is attached to an inner wythe as part of an anchoring system, the thermal spacer 186 interrupts the thermal pathway through the cavity wall. In other words, the transmission of heat between the outer wythe (via a veneer tie attached to the outer wythe and attached to the wall anchor 140) and the inner wythe (via the wall anchor attached to the inner wythe) of a cavity wall is reduced. The thermal spacer 186 preferably has a thickness selected to provide a thermal break between thermally-conductive portions 170, 172 attached to the thermal spacer. For example, in one embodiment, the thermal spacer 186 has a thickness t of about 0.250 inches (6.35 mm). Other configurations are within the scope of the present invention. For example, the studs 190, 192 can be separate from both the larger diameter barrel portion 160 and the thermal spacer 186, which can each include a threaded opening to receive the studs. Alternatively, the studs 190, 192 can be formed as a part of the thermal spacer 186 and the first and second thermally-conductive portions 170, 172 can include threaded openings configured to receive the studs. In one embodiment, a single stud made of stainless steel, plastic, or other suitable material extends through the thermal spacer to attach the first and second thermally-conductive portions 170, 172 to each other. Alternatively, one or two hollow threaded rods made of stainless steel, plastic, or other suitable material can connect the thermal spacer 186 and the thermally-conductive portions 170, 172.

Figure 7:
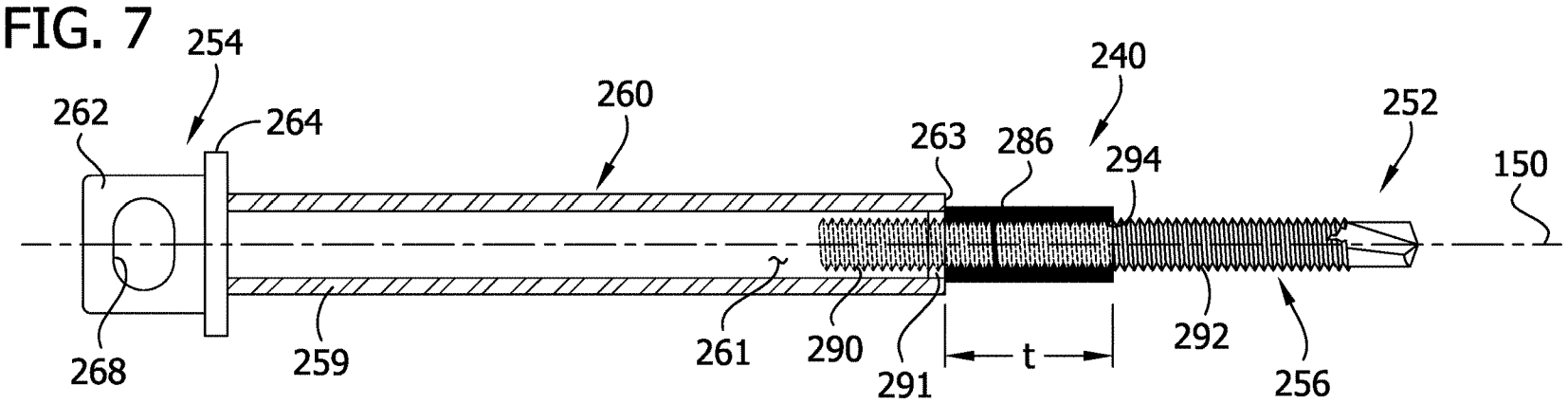
FIG. 7 is a front view in partial section of a third embodiment of a thermal wall anchor.
Figure 8:
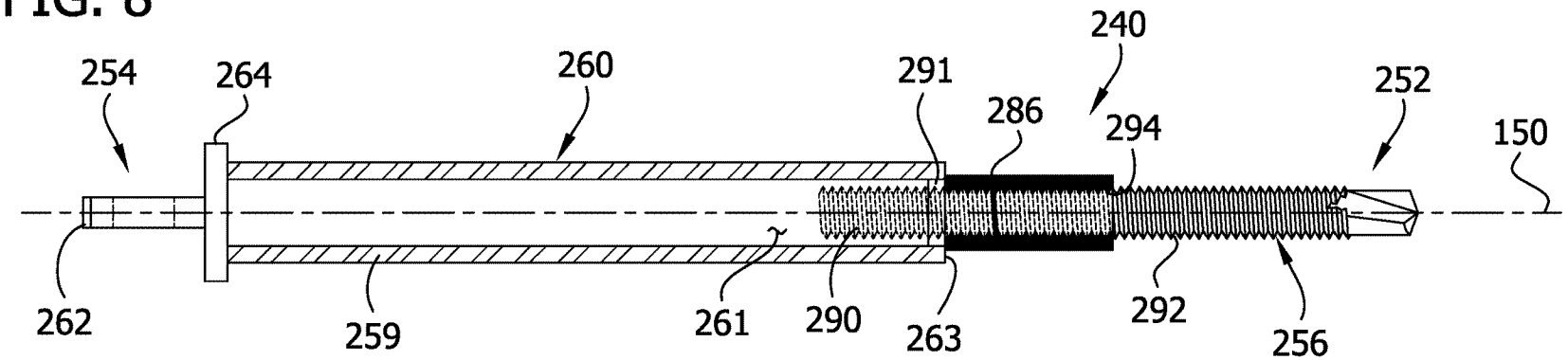
FIG. 8 is a top plan view in partial section of the thermal wall anchor of FIG. 7.

A third embodiment of a wall anchor with thermal spacer is illustrated in FIGS. 7 and 8. Wall anchor 240 is substantially similar to wall anchors 40, 140 described above, with differences as pointed out herein. Parts of the wall anchor 240 corresponding to parts of the anchor 40 are given the same reference numeral, plus "200."

Wall anchor 240 includes an elongate body that extends along the longitudinal axis 250 of the anchor from a driven end portion 252 to a driving end portion 254. The driven end portion 252 includes a threaded portion 256 configured for attachment to an inner wythe (e.g., a metal stud). Wall anchor 240 is used as described above with reference to wall anchor 40. Wall anchor 240 includes a single diameter barrel 260. The barrel 260 comprises a hollow body having a circumferential wall 259 defining an open interior 261. A drive head 262 is located at the driving end portion 254 of the anchor 240. The elongate body includes a flange 264 at the junction of the drive head 262 and the barrel 260. The drive head 262 defines a receptor or aperture 268 for receiving a portion of a veneer tie, as described above. The elongate body includes an axial end surface 263 at a free end of the barrel 260 opposite the drive head 262.

The wall anchor 240 includes a thermal spacer 286 that is configured to provide a thermal break in the wall anchor. The main components of the wall anchor 240 are preferably made of metal (e.g., steel) to provide a high-strength anchoring system. Alternatively, the wall anchor can be made of plastic or other suitable material. In one embodiment, the main components of the wall anchor are made of stainless steel. Through the use of a thermal spacer 286, the thermal transmission values of the wall anchor are lowered. The thermal spacer 286 is preferably a non-conductive material. For example, the thermal spacer 286 can be ceramic, plastic, epoxy, carbon fiber, a non-conductive metal, or other non-conductive material.

As seen in FIGS. 7 and 8, the thermal spacer 286 is positioned adjacent the axial end surface 263 of the barrel 260. The thermal spacer 286 is attached to the threaded portion 256 of the wall anchor 240. For example, the thermal spacer 286 is threadedly mounted on the threaded portion 256. As illustrated, the threaded portion 256 includes a barrel attachment portion 290 and an inner wythe attachment portion 292. The thermal spacer 286 includes a threaded opening 294 configured to receive the barrel attachment portion 290 and the inner wythe attachment portion 292. One end of the barrel attachment stud 290 is attached to the barrel 260. Specifically, the barrel attachment stud 290 is threadedly attached to the barrel 260, such as by threaded engagement with a nut 291 positioned at the free end of the elongate body of the wall anchor 240. The other end of the barrel attachment portion 290 is threadedly attached to the thermal spacer 286. As illustrated in FIGS. 7 and 8, when both the barrel attachment portion 290 and the inner wythe attachment portion 292 are received in the threaded opening 294 of the thermal spacer 286, the portions 290, 292 are spaced from each other and do not make contact. Other attachment configurations are within the scope of the present invention. For example, the threaded portion 256 can be a single threaded screw that is attached to both the barrel 260 and the thermal spacer 286. The threaded portion 256 can be made of stainless steel, plastic, fiberglass, or other suitable material. In one embodiment, the threaded portion 256 is hollow.

The thermal spacer 286 is configured to provide a thermal break between the barrel 260 and an inner wythe to which the barrel is attached. Thus, when the wall anchor 240 is attached to an inner wythe as part of an anchoring system, the thermal spacer 286 interrupts the thermal pathway through the cavity wall. In other words, the transmission of heat between the outer wythe (via a veneer tie attached to the outer wythe and attached to the wall anchor 240) and the inner wythe (via the wall anchor attached to the inner wythe) of a cavity wall is reduced. The thermal spacer 286 preferably has a thickness selected to provide a thermal break between the wall anchor 240 and an inner wythe. For example, in one embodiment, the thermal spacer 286 has a thickness t of about 0.688 inches (17.475 mm).

A fourth embodiment of a wall anchor with thermal spacer is illustrated in FIGS. 9-12. Wall anchor 340 is substantially similar to wall anchors 40, 140, 240 (and particularly to anchor 240) described above, with differences as pointed out herein. Parts of the anchor corresponding to parts of the anchor 240 are given the same reference numeral, plus "100."

Wall anchor 340 includes an elongate body that extends along the longitudinal axis 350 of the anchor from a driven end portion 352 to a driving end portion 354. The driven end portion 352 includes a threaded portion 356 configured for attachment to an inner wythe (e.g., a metal stud). Wall anchor 340 is used as described above with reference to wall anchor 40. Wall anchor 340 includes a single diameter barrel 360. The barrel 360 comprises a hollow body having a circumferential wall 359 defining an open interior 361. A drive head 362 is located at the driving end portion 354 of the anchor 340. The elongate body includes a flange 364 at the junction of the drive head 362 and the barrel 360. The drive head 362 defines a receptor or aperture 368 for receiving a portion of a veneer tie, as described above. The elongate body includes an axial end surface 363 at a free end of the barrel 360 opposite the drive head 362.

The wall anchor 340 includes a thermal spacer 386 that is configured to provide a thermal break in the wall anchor. The main components of the wall anchor 340 are preferably made of metal (e.g., steel) to provide a high-strength anchoring system. Alternatively, the wall anchor can be made of plastic or other suitable material. In one embodiment, the main components of the wall anchor are made of stainless steel. Through the use of a thermal spacer 386, the thermal transmission values of the wall anchor are lowered. The thermal spacer 386 is preferably a non-conductive material. For example, the thermal spacer 386 can be ceramic, plastic, epoxy, carbon fiber, a non-conductive metal, or other non-conductive material.

As seen in FIGS. 9-12, the thermal spacer 386 is positioned adjacent the axial end surface 363 of the barrel 360. The thermal spacer 386 is attached to the threaded portion 356 of the wall anchor 340. For example, the thermal spacer 386 is threadedly mounted on the threaded portion 356. As illustrated, the threaded portion 356 includes a barrel attachment portion or stud 390 and an inner wythe attachment portion 392. The thermal spacer 386 includes a threaded opening 394 configured to receive the barrel attachment portion 390 and the inner wythe attachment portion 392. One end of the barrel attachment stud 390 is attached to the barrel 360. Specifically, the barrel attachment stud 390 is threadedly attached to the barrel 360, such as by threaded engagement with a nut 391 positioned at the free end of the elongate body of the wall anchor 340. The other end of the barrel attachment stud 390 is threadedly attached to the thermal spacer 386. As illustrated in FIGS. 9-12, when both the barrel attachment stud 390 and the inner wythe attachment portion 392 are received in the threaded opening 394 of the thermal spacer 386, the portions 390, 392 are spaced from each other and do not make contact. Other attachment configurations are within the scope of the present invention. For example, the threaded portion 356 can be a single threaded screw that is attached to both the barrel 360 and the thermal spacer 386. The threaded portion 356 can be made of stainless steel, plastic, fiberglass, or other suitable material. In one embodiment, the threaded portion 356 is hollow.

The thermal spacer 386 is configured to provide a thermal break between the barrel 360 and an inner wythe to which the barrel is attached. Thus, when the wall anchor 340 is attached to an inner wythe as part of an anchoring system, the thermal spacer 386 interrupts the thermal pathway through the cavity wall. In other words, the transmission of heat between the outer wythe (via a veneer tie attached to the outer wythe and attached to the wall anchor 340) and the inner wythe (via the wall anchor attached to the inner wythe) of a cavity wall is reduced. The thermal spacer 386 preferably has a thickness selected to provide a thermal break between the wall anchor 340 and an inner wythe. For example, in one embodiment, the thermal spacer 386 has a thickness t of about 0.688 inches (17.475 mm).

Figure 9:
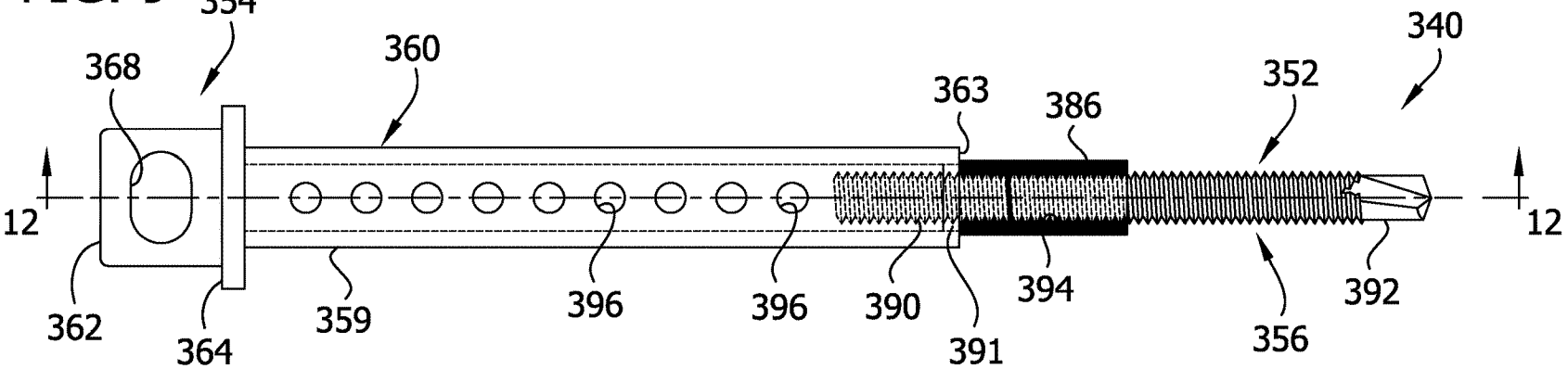
FIG. 9 is a front view in partial section of a thermal wall anchor according to a fourth embodiment, the rear view being identical thereto.
Figure 10:
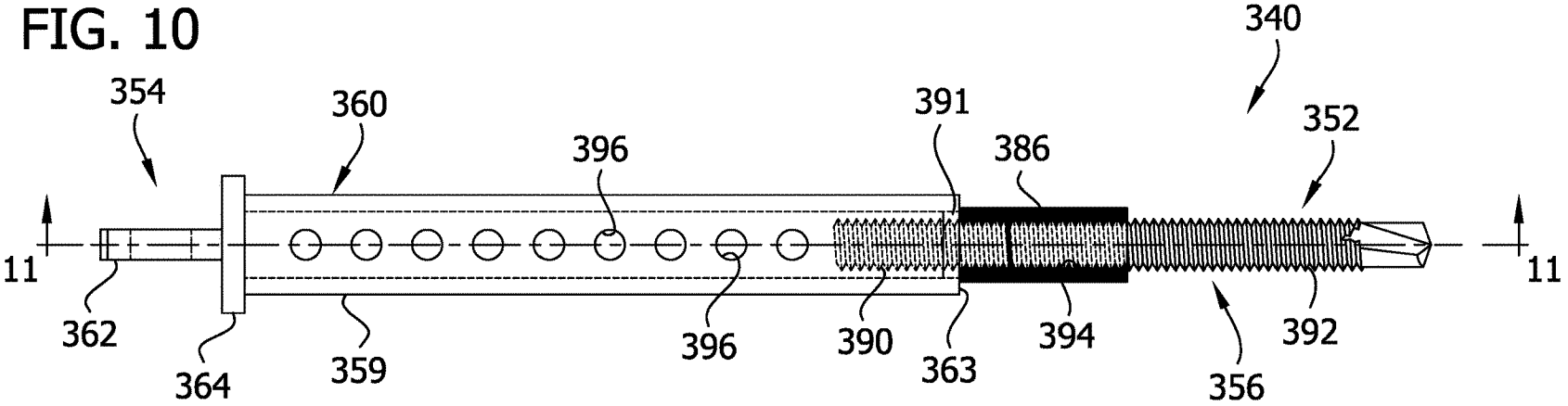
FIG. 10 is a top plan view thereof, the bottom plan view being identical thereto.
Figure 11:
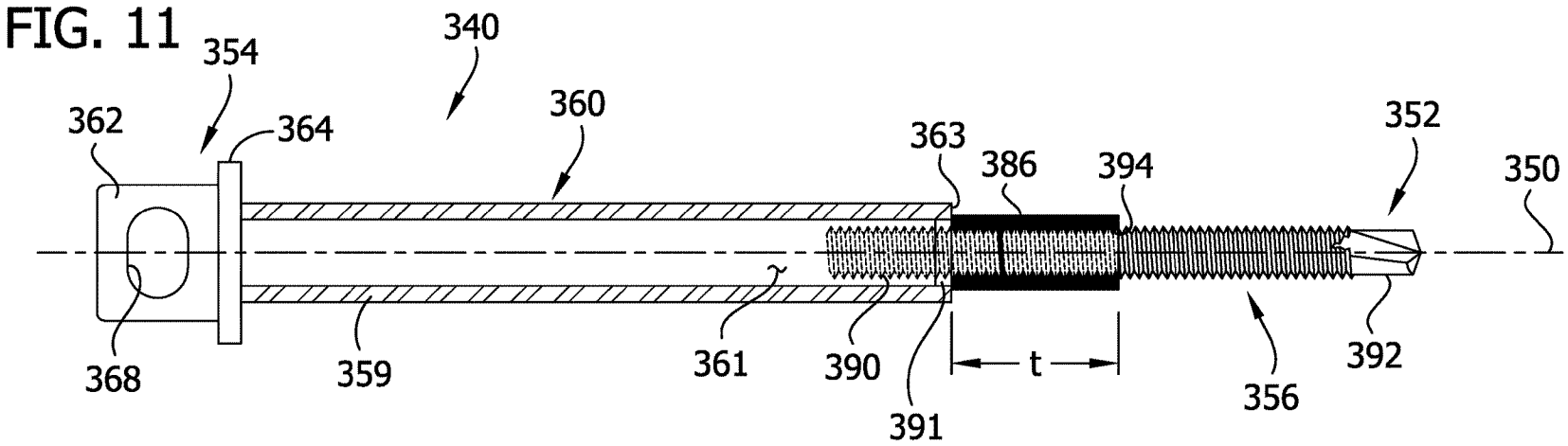
FIG. 11 is a partial section taken through line 11-11 of FIG. 10.
Figure 12:
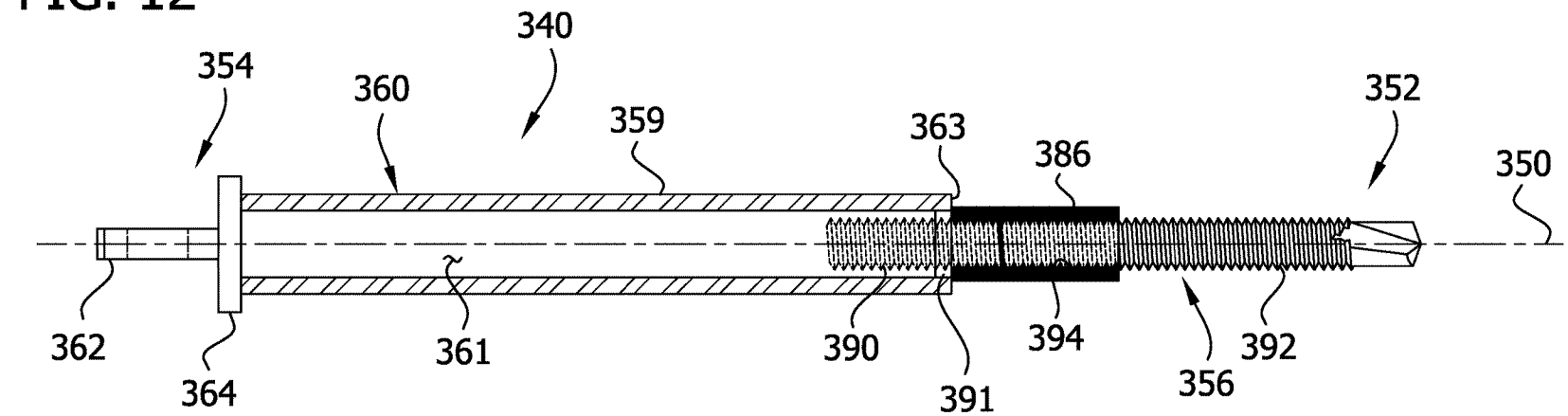
FIG. 12 is a partial section taken through line 12-12 of FIG. 9.

At least one opening 396 extends through the wall 359 of the barrel 360. As illustrated in FIGS. 9 and 10, a plurality of openings 396 extend through the wall 359. The openings 396 reduce the mass of the wall anchor 340. The reduction in mass in the wall anchor 340 correspondingly reduces the amount of thermal transfer between the wall anchor and a veneer tie attached to the wall anchor. In one embodiment, the total surface area of the wall 359 of the barrel 360 is reduced by an amount in a range of about 5% to about 95% by the openings 396 as compared to what the total surface area of the wall would be if the hollow body did not include any openings. In one embodiment, the total surface area of the wall 359 is reduced by an amount in a range of about 5% to about 75%, such as by 5%, by 10%, by 20%, by 25%, by 30%, by 35%, or by any other suitable amount. As illustrated, the wall anchor 340 includes openings 396 spaced along the length of the barrel 360. The openings 396 are uniformly spaced along the length of the barrel 360. The openings 396 are uniformly spaced around a circumference of the barrel 360. Each opening 396 extends through the circumferential wall 359 to the hollow interior 361. Each opening 396 aligns with a corresponding diametrically opposed opening 396. Each opening 396 is generally circular and is generally the same size. Other opening configurations and arrangements are within the scope of the present invention. For example, the openings 396 may not be uniformly sized or arranged to be uniformly spaced along the length and/or around the circumference of the barrel 360. The anchor 340 can include more openings 396 than illustrated, or fewer openings than illustrated. The openings 396 can have other shapes or configurations, or may have varying shapes, sizes, spacing, and configurations.

The anchors as described above serve to thermally isolate the components of the anchoring system, thereby reducing the thermal transmission and conductivity values of the anchoring system as a whole. The anchors provide an insulating effect and an in-cavity thermal break, severing the thermal pathways created from metal-to-metal contact of anchoring system components. The present invention maintains the strength of the metal and further provides the benefits of a thermal break in the cavity.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A wall anchor for use in a cavity wall to connect to a veneer tie to join an inner wythe and an outer wythe of the cavity wall, the wall anchor comprising an elongate body having a longitudinal axis, a driven end portion, a receptor portion, at least one barrel portion positioned between the driven end portion and the receptor portion and connecting the receptor portion to the driven end portion, and a thermal spacer interposed between the barrel portion and a section of the driven end portion, the driven end portion being adapted to be threadedly mounted on the inner wythe of the cavity wall and including a barrel attachment portion, the receptor portion including a receptor opening for capturing a portion of the veneer tie, the receptor opening extending transverse to the longitudinal axis of the elongate body through the receptor portion, the at least one barrel portion comprising a hollow body having a circumferential wall defining a hollow interior extending between opposite ends of the at least one barrel portion, the barrel attachment portion being received in the hollow interior, the barrel attachment portion and the circumferential wall defining a gap therebetween in the hollow interior of the barrel portion, wherein the at least one barrel portion comprises at least one opening extending through the circumferential wall to the hollow interior.

2. The wall anchor of claim 1, wherein the at least one barrel portion comprises a plurality of openings extending through the circumferential wall to the hollow interior.

3. The wall anchor of claim 2, wherein the plurality of openings reduces the material of the hollow body by an amount in a range of 5% to 35%.

4. The wall anchor of claim 1, wherein the thermal spacer mounts the section of the driven end portion on the barrel portion.

5. The wall anchor of claim 1, wherein the driven end portion further includes an inner wythe attachment portion, the thermal spacer being interposed between the barrel attachment portion and the inner wythe attachment portion.

6. The wall anchor of claim 5 wherein the thermal spacer connects the inner wythe attachment portion to the barrel attachment portion.

7. The wall anchor of claim 5, wherein the inner wythe attachment portion is threadably attached to the thermal spacer.

8. The wall anchor of claim 7, wherein the barrel attachment portion is threadably attached to the thermal spacer and spaced from the inner wythe attachment portion by the thermal spacer.

9. The wall anchor of claim 8, wherein the thermal spacer includes internal threads for connecting to the barrel attachment portion and for connecting to the inner wythe attachment portion.

10. The wall anchor of claim 9, wherein the barrel attachment portion is threadably attached to the barrel portion.

11. The wall anchor of claim 8, wherein the at least one barrel portion has an axially facing end surface, the thermal spacer having a conductivity less than a thermal conductivity of the elongate body and being configured and arranged to reduce thermal transfer in the cavity wall along the elongate body, an axially facing end surface of the thermal spacer engaging the axially facing end surface of the at least one barrel portion, the thermal spacer extending axially therefrom away from the receptor portion, the thermal spacer being attached to the driven end portion such that the thermal spacer is disposed between the axially facing end surface of the at least one barrel portion and the section of the driven end portion and provides a barrier to communication of thermal energy from the section of the driven end portion and the barrel portion.

12. The wall anchor of claim 11, wherein the at least one barrel portion comprises a plurality of openings extending through the circumferential wall to the hollow interior.

13. The wall anchor of claim 12, wherein the plurality of openings reduces the material of the hollow body by an amount in a range of 5% to 35%.

14. The wall anchor of claim 1, wherein the thermal spacer is a material selected from the group consisting of ceramic, plastic, epoxy and carbon fiber.

15. The wall anchor of claim 1, wherein the driven end portion is a material selected from the group consisting of stainless steel, plastic, epoxy and fiberglass.

* * * * *